US008272082B1

(12) United States Patent
Price

(10) Patent No.: US 8,272,082 B1
(45) Date of Patent: Sep. 25, 2012

(54) TUB BOX APPARATUS, SYSTEMS AND INSTALLATION METHODS

(75) Inventor: Darrell W Price, Rockledge, FL (US)

(73) Assignee: MHubbard 09, LLC, Vista, CA (US)

( * ) Notice: Subject to any disclaimer, the term of this patent is extended or adjusted under 35 U.S.C. 154(b) by 1306 days.

(21) Appl. No.: 11/934,302

(22) Filed: Nov. 2, 2007

(51) Int. Cl.
*E03C 1/22* (2006.01)
*E03C 1/24* (2006.01)

(52) U.S. Cl. ..... 4/680; 4/683; 4/695

(58) Field of Classification Search ..... 4/252.5, 4/262.6, 680, 683, 684, 679, 695; 52/220.8
See application file for complete search history.

(56) References Cited

U.S. PATENT DOCUMENTS 3,431,566 A * 3/1969 Feldhege ..... 4/680
3,633,219 A * 1/1972 Byrd ..... 137/363
4,338,688 A 7/1982 Petty
4,403,355 A * 9/1983 Petty ..... 4/679
4,762,440 A * 8/1988 Argandona ..... 405/52
4,823,527 A 4/1989 Harbeke
4,848,043 A 7/1989 Harbeke
4,888,925 A 12/1989 Harbeke
4,953,235 A 9/1990 Cornwall
5,325,549 A 7/1994 Cornwall
5,953,872 A 9/1999 MacMillian et al.
6,336,297 B1 1/2002 Cornwall
6,615,860 B2 9/2003 Didone et al.
6,848,227 B2 2/2005 Whitty
2007/0175649 A1 8/2007 Moselle

* cited by examiner

*Primary Examiner* — Dinh Q Nguyen
(74) *Attorney, Agent, or Firm* — Brian S. Steinberger; Law Offices of Brian S. Steinberger, P.A.

(57) ABSTRACT

Tub box systems, apparatus and methods of assembling in concrete floors under bath tubs. Tub boxes with water sealing members can include troughs/gutters about the perimeter edges of the tub box which collect water leakage between the tub box and concrete floors. Raised ribs on the outside of the tub boxes block water flowing on the surfaces of the tub box from reaching lower drain lines. Water barrier rings with flat outwardly extending sides and concentric raised ridges which attach about downwardly projecting drain bases underneath the tub box further prevent water leaks running down the drain bases. Fire stop material can be clipped about the drain bases and expand from heat to prevent fire from traveling upward around the drain lines in the concrete floors under bathtubs.

15 Claims, 17 Drawing Sheets

720
715
710
SEE FIG. 8B
SEE FIG. 8C
SECTION 8A-8A
717

719

8A
8A
700

TUB BOX APPARATUS, SYSTEMS AND INSTALLATION METHODS

This invention relates to floors that receive plumbing systems, in particular to apparatus, systems and methods of installing and preparing concrete poured floors for bathtub type plumbing systems and for sealing and preventing water leakage about tub boxes and floor drains and forming fire stops about the floor based piping systems.

BACKGROUND AND PRIOR ART

In the past it has been known to extend piping systems through concrete floors by knocking out holes in the floor and boring such holes after the floor has been formed, and then extending pipes through the floors. After the pipes have been inserted into the holes, workman have had to pour additional material such as more concrete or other caulking material to seal up the spaces between the voids and the pipes extending through the voids. However, such attempts to use concrete or caulk to seal up the spaces has not been effective to future problems down the road such as from water leaks and fires that travel through any void spaces between the floors.

Any water caused by overflowing tubs, leaks, broken water lines, etc., can end up at the tub box, drain and the perimeter of the tub box.

However, the traditional bathtub tub boxes installed in concrete floors underneath the piping system still allow for substantial water leakage. For example, water traveling on a concrete floor toward a tub box has been known to pour into any minute crevice about the perimeter of the tub box. Additionally, water flowing directly into the tub box can overfill the box and also pour into any sized crevice or crack about the perimeter of the tub box. Still furthermore, the exterior perimeter of the main pipe lines still have void spaces that are not fully sealed by extra concrete and/or caulk so that water leaks can still flow downward around the main piping drains that run through the floors.

Any water then flowing downward through the flooring will eventually cause damage to the ceiling and rooms beneath the bathtub. This problem becomes compounded in high rises having multiple bathrooms on each floor, where large amounts of damage often results in costly repairs and exasperation, and downtime for the users of those bathrooms. Furthermore, constant leaks have been known to cause health hazards since undesirable and dangerous mold and bacteria will form around the leak areas.

Additionally, tub boxes have generally been boxes with thin side sides and floors that are may not be durable to last over many years.

Still furthermore, the crevices and cracks about the piping systems in the floors are also a conduit for fires traveling upward through a multi-floor building. Again, current sealing techniques that have included concrete and/caulk do not effectively seal against all void spaces about the main drain lines. In fact fires have often had the opposite effect of shrinking any caulk seals which results in opening of the crevices and voids about the plumbing systems causing a pathway for fires to travel through the floors of the buildings about the pluming systems.

Various types of floor preparing techniques have been proposed over the years. See for example, U.S. Pat. Nos. 4,338,688 to Petty; 4,823,527 to Harbeke; 4,848,043 to Harbeke; 4,888,925 to Harbeke; 4,953,235 to Cornwall: 5,325,549 to Cornwell; 5,953,872 to MacMillian et al.; 6,336,297 to Cornwall; 6,615,860 to Didone et al.; 6,848,227 to Whitty; and U.S. Published Patent Application: 2007/0175649 to Moselle. However, none of these techniques solves all the problems addressed above.

Thus, the need exists for solutions to the above problems with the prior art.

SUMMARY OF THE INVENTION

A primary objective of the present invention is to provide apparatus, systems and methods of preparing concrete poured floors for bathtub type plumbing systems and for sealing and preventing water leaks traveling on floors to tub boxes and passing through the crevices/cracks between the tub boxes and the floors and continuing onward.

A secondary objective of the present invention is to provide apparatus, systems and methods of preparing concrete poured floors for bathtub type plumbing systems and for sealing and preventing overflow water leaks from tub boxes through the crevices/cracks between the tub boxes and the floors and continuing a downward travel.

A third objective of the present invention is to provide apparatus, systems and methods of preparing concrete poured floors for bathtub type plumbing systems and for sealing and preventing water leakage through crevices/cracks about main piping drain lines between the floors and continuing downward.

A fourth objective of the present invention is to provide apparatus, systems and methods of preparing concrete poured floors for bathtub type plumbing systems with tub boxes that are strengthened to last longer overtime with rib members that also obstruct the flow of leaks flowing around the tub boxes.

A sixth objective of the present invention is to provide apparatus, systems and methods of fire stop seals in voids/spaces and crevices/cracks about main piping drain lines between the floors.

A seventh objective of the present invention is to provide apparatus, systems and methods of forming fire stops in any voids/spaces and crevices/cracks about main piping drains between the floors with heat expandable fire stop material wrapped about pipes.

A preferred embodiment of the tub box assembly for concrete flooring can include a tub box having a floor and perimeter side walls encircling about the floor, and a seal member for preventing water leakage from passing through concrete floor in which the tub box is installed, and passing downward.

The seal member can include a trough completely encircling about all exterior perimeter side walls of the tub box, wherein the trough forms a gutter for collecting any of the water passing around the exterior edges of the perimeter wall and the concrete floor and helping any water in the trough to be absorbed back into the concrete.

The trough can be mounted below a top edge of the perimeter side walls of the tub box, and be sloped downward from the rear of the tub box to the front. An elongated sponge material within the trough for absorbing any water that collects inside.

The seal member can also include a base extending downward from a main drain opening in the tub box, along with a water barrier lower seal about the base, the water barrier lower seal able to expand and contract with the concrete floor in which it is installed while forming water seal between the concrete floor and the tub box base. The water barrier lower seal can include a resilient ring having flat sides extending outward from a center opening, and at least one concentric raised ridge in the flat sides. The ring can have at least one concentric raised ridge is protrudes upward. Alternatively, the ring can have at least one concentric raised ridge protrudes downward. Still furthermore, the ring can have a combination of at least one upward protruding ridge on the flat sides and at least one downward protruding ridge on the flat sides.

The tub box can have rows of raised ribs underneath the floor and about exterior of the perimeter side walls for both strengthening the tub box and for obstructing the water leakage flowing around the tub box.

The tub box can have a fire stop material circumferentially wrapped about a lower portion of the downwardly extending base, the fire stop material expands from heat to prevent fire from traveling upward around the main drain opening.

The fire stop material can be held in place by a ring shaped clip with a central opening and upwardly projecting bendable prongs, wherein the central opening of the ring shaped clip fits about the main drain opening, and the bendable clips hold the fire stop material about the lower portion of the downwardly extending base. The bendable clips hold the fire stop material about the lower portion of the downwardly extending base and the outside prongs on the fire ring are for securing the ring in to the concrete.

Another embodiment of the tub box system for concrete flooring, can have the combination of a tub box having a floor and perimeter side walls encircling about the floor, a trough completely encircling about all exterior perimeter side walls of the tub box, wherein the trough forms a gutter for collecting any of the water passing around the exterior edges of the perimeter wall and the concrete floor, a base extending downward from a main drain opening in the tub box, and a water barrier lower seal about the base, the water barrier lower seal able to expand and contract with the concrete floor in which it is installed while forming water seal between the concrete floor and the tub box base, the water barrier lower seal having a ring having flat sides extending outward from a center opening, with at least one concentric raised ridge on the flat sides, and a fire stop material wrapped about a lower portion of the downwardly extending base, the fire stop material expands from heat to prevent fire from traveling upward about the main drain opening.

The invention can include a method of preventing water leakage beneath tub boxes, that can include the steps of providing a tub box having a floor with a main drain and perimeter side walls encircling about the floor and a downwardly extending base beneath the main drain, inserting the tub box into a concrete floor, and preventing water leakage from passing through concrete floor in which the tub box is installed.

The water leakage preventing step can include collecting the water leakage between the tub box and the concrete floor by a trough-gutter which substantially encircles the perimeter side walls of the tub box and helping any water that is in the trough to be drawn back into the concrete.

The water leakage preventing step can include blocking the water leakage about the downwardly extending base by a ring having outwardly extending flat sides with at least one concentric raised ridge on the flat sides.

The water leakage preventing step can include preventing water flowing about the tub box by rows of raised ribs located underneath the floor and about exterior surfaces of the perimeter side walls, and strengthening the tub box with the rows of raised ribs on the tub box.

The method can further include fire stops that include the steps of wrapping fire stop material circumferentially about a lower portion of the downwardly extending base of the tub box, expanding the fire stop material by heat generated by a fire, and blocking fire from traveling up around the sealing the base with the concrete floor with the expanded fire stop material.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Figure 1:
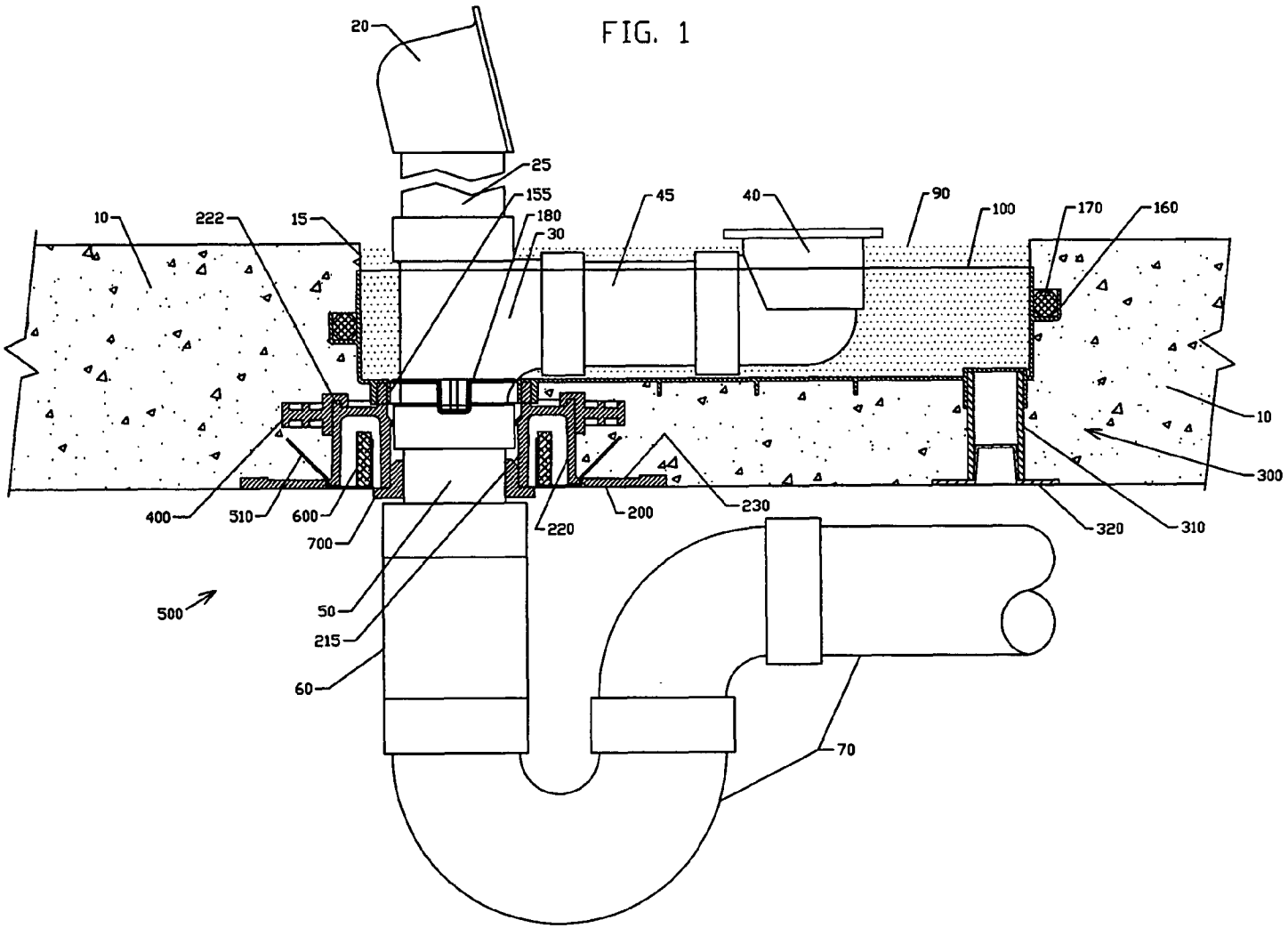
FIG. 1 is a cross-sectional side view of a tub box assembly embodiment for a 1.5" drain installed in a concrete floor.
Figure 9:
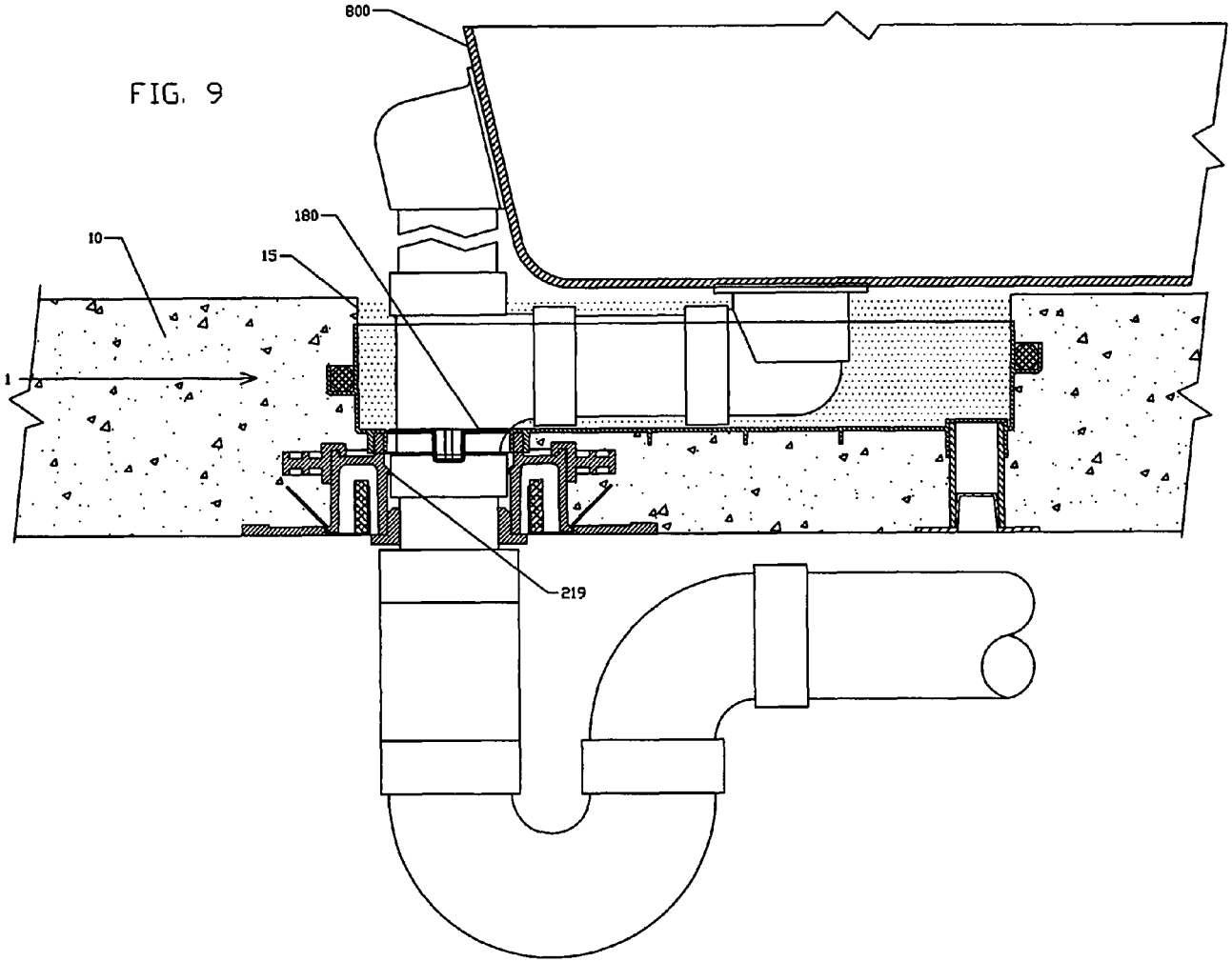
FIG. 9 is another cross-sectional view of the assembled tub box assembly in a concrete floor with bathtub mounted to the tub box assembly.

1 tub box assembly
10 concrete floor
15 opening in floor for tub box
20 side drain overflow ninety degree coupling
25 overflow drain pipe
30 t-coupling
40 bottom drain ninety degree coupling
45 drain pipe
50 upper vertical drain pipe in tub box
60 lower coupling to vertical drain pipe
70 below floor drain pipe
90 foam insert
100 tub box
110 front wall
120 side wall
130 opposite side wall
140 rear wall
142 left rear pipe leg coupling
148 right rear pipe leg coupling
150 floor
155 main drain opening
157 main drain coupling
160 trough/gutter
170 rod seal member/upper water barrier
180 upper seal
190 parallel raised ribs
200 tub box base
210 elongated pipe upper base
215 lower end of elongated pipe base
220 inside wall lower base
222 raised circumferential edge
230 mounting plate
300 tub knockout
301 rear pipe legs
310 left rear pipe leg
320 left rear pipe leg support
330 right rear pipe leg
340 right rear pipe leg support
400 water barrier lower seal
410 inner clip edge
420 upper roof edge
430 outer wall member
440 flat ring
450 upper concentric ridges
460 lower concentric ridges
500 fire stop assembly
510 fire ring anchoring prongs
520 lower fire stop ring
530 prongs that hold fire material
600 fire stop wrap
700 lower seal member for tub box base
710 plug/seal
715 inwardly angled edge
717 sealing protruding ring
719 sealing protruding ring
720 plug seal top
800 bathtub
1000 another assembled tub box FIG. 1 is a cross-sectional side view of a fully assembled embodiment of a tub box assembly embodiment 1 for a 1.5" drain installed in a concrete floor 10. A side drain overflow coupling 20 (the significance of which is shown later in FIG. 9) can be attached to a t-coupling 30 that can be mounted inside the main drain opening 155 of the tub box 100. A bottom drain coupling 40 (the significance of which is shown in FIG. 9) can be attached to another end of the t-coupling 30, the latter of which can be attached to an upper vertical drain pipe 50 that passes through a tub box base 200 and to a lower coupling pipe 60, which can be attached to a standard drain lines 70 that can run beneath the concrete flooring 10.

Figure 2A:
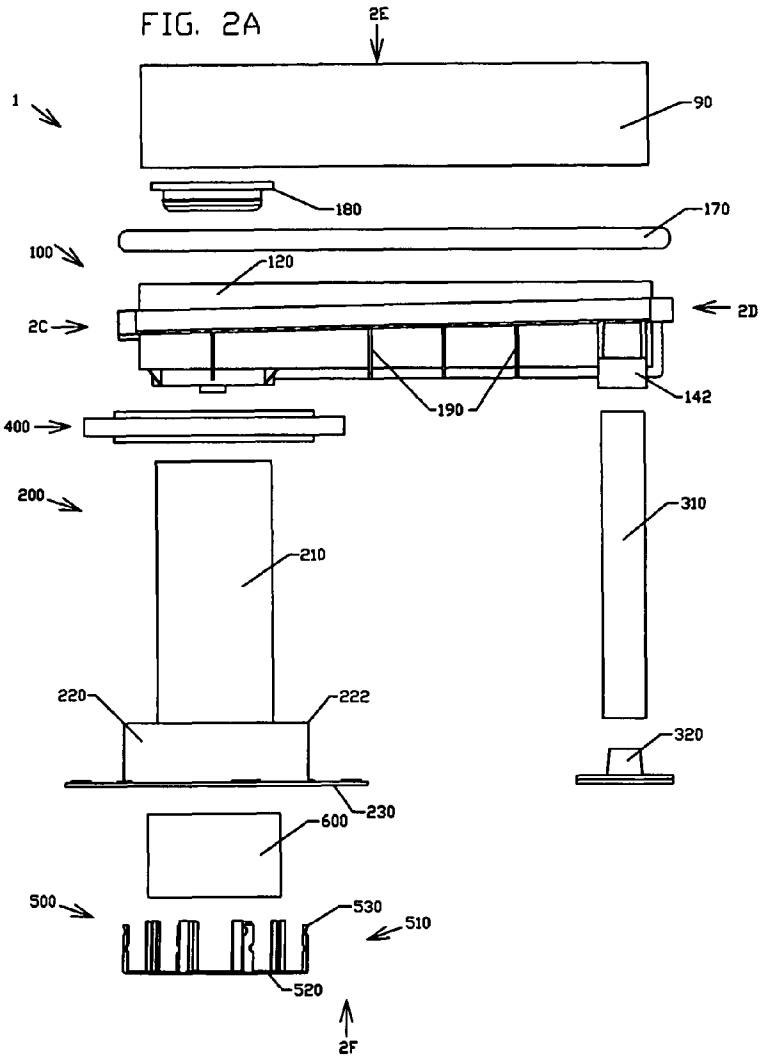
FIG. 2A is an exploded side view of the tub box assembly of FIG. 1
Figure 2B:
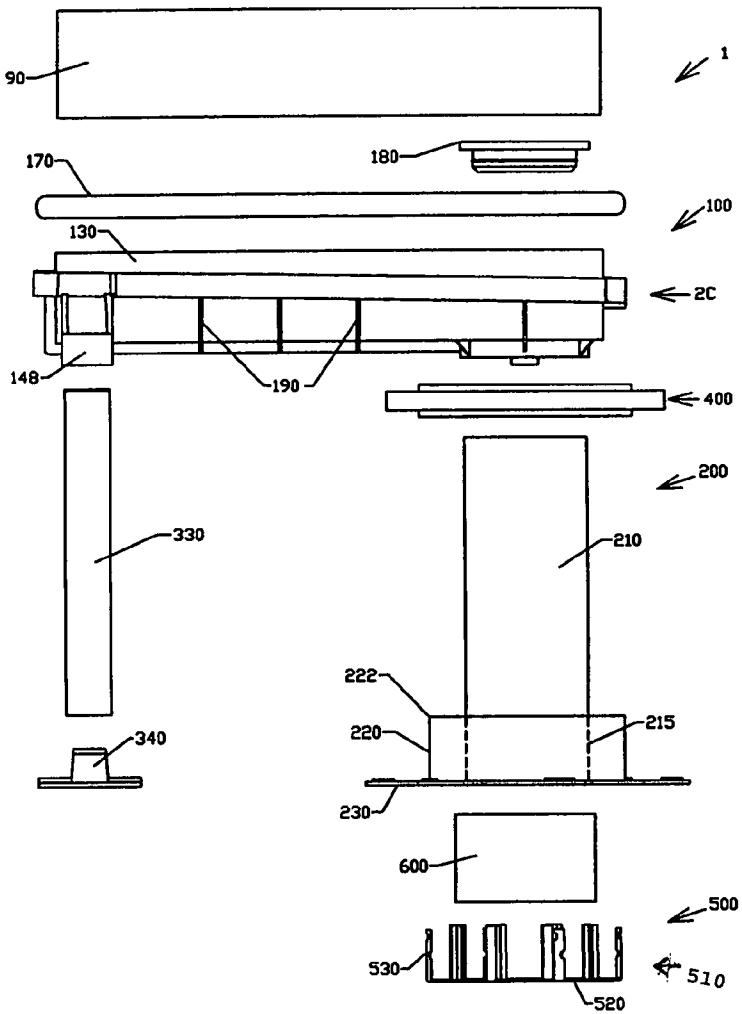
FIG. 2B is an exploded opposite side view of the tub box assembly of FIG. 1.
Figure 2C:
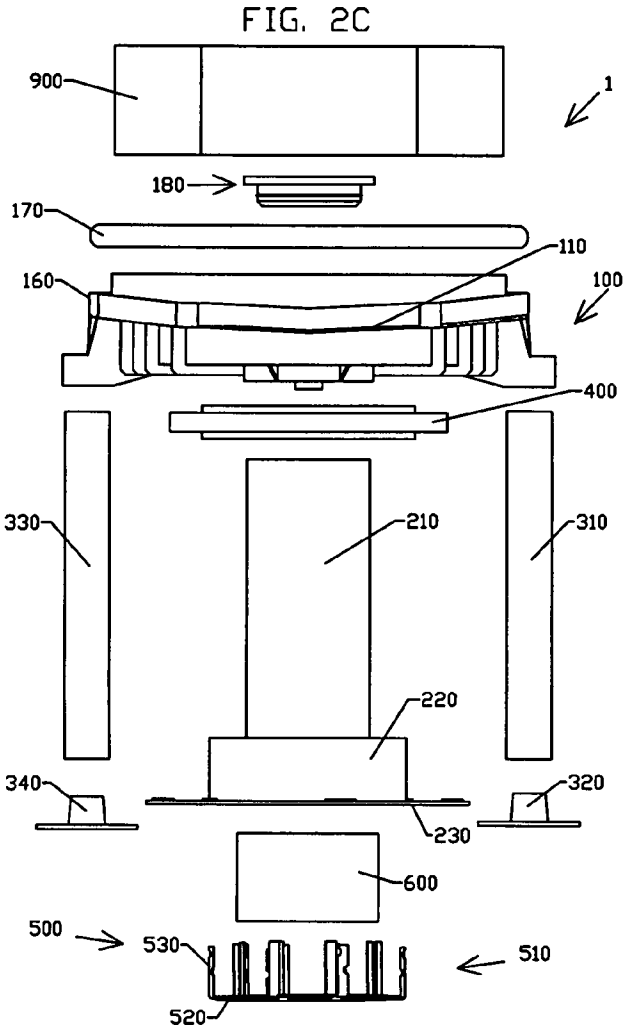
FIG. 2C is a front end exploded view of the tub box assembly of FIG. 2A along arrow 2C.
Figure 2D:
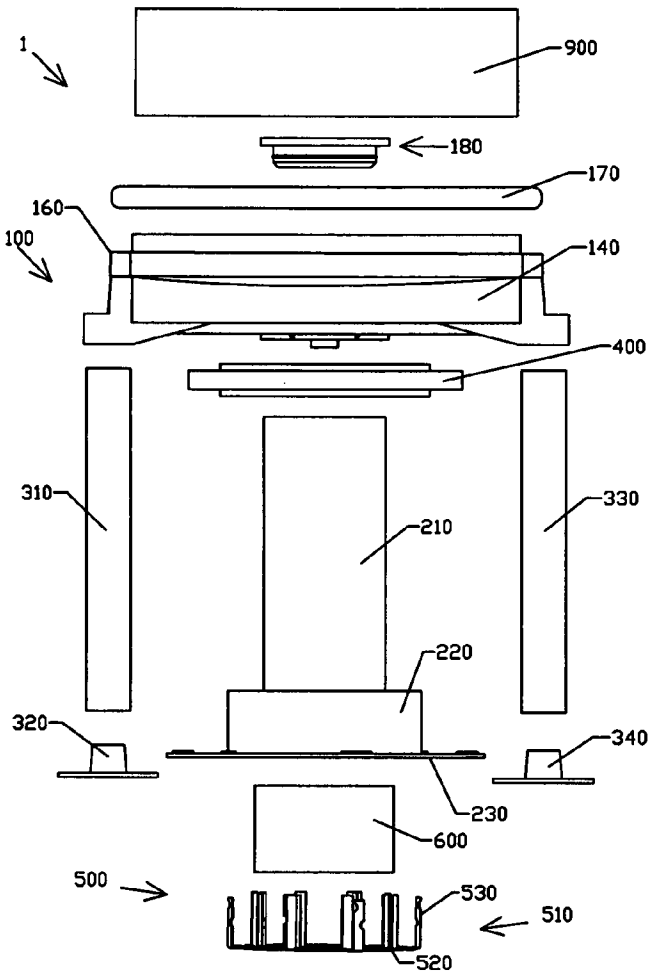
FIG. 2D is a rear end exploded view of the tub box assembly of FIG. 2A along arrow 2D.
Figure 2E:
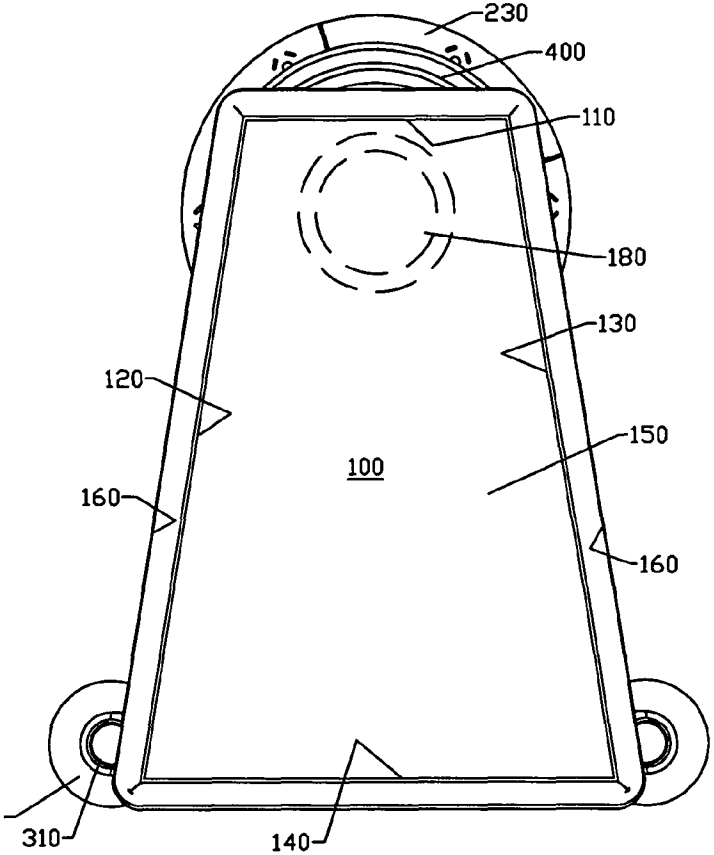
FIG. 2E is a top view of the tub box assembly of FIG. 2A along arrow 2E.
Figure 2F:
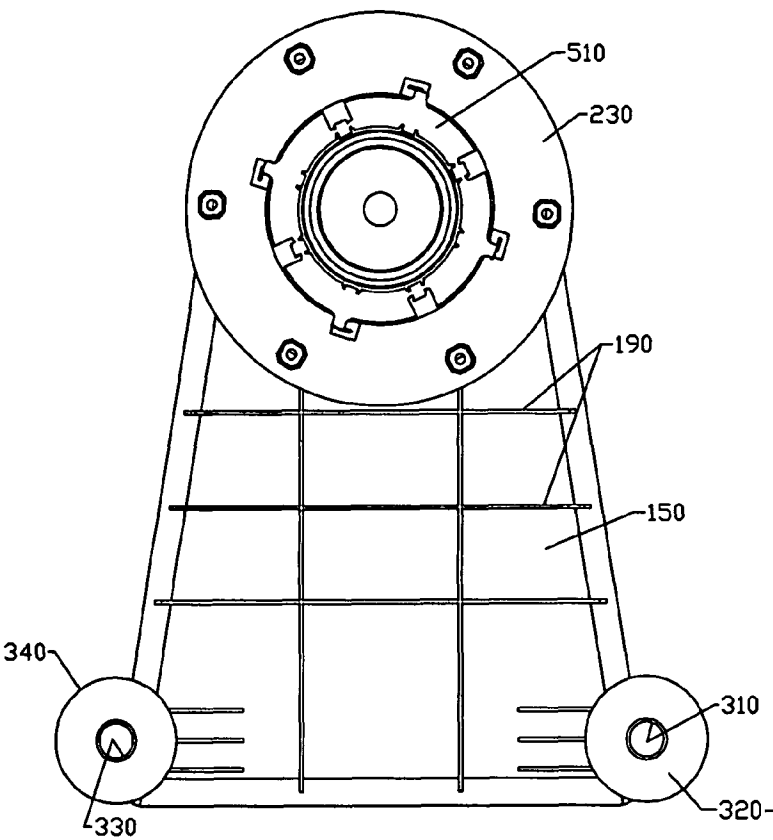
FIG. 2F is a bottom view of the tub box assembly of FIG. 2A along arrow 2F.
Figure 2G:
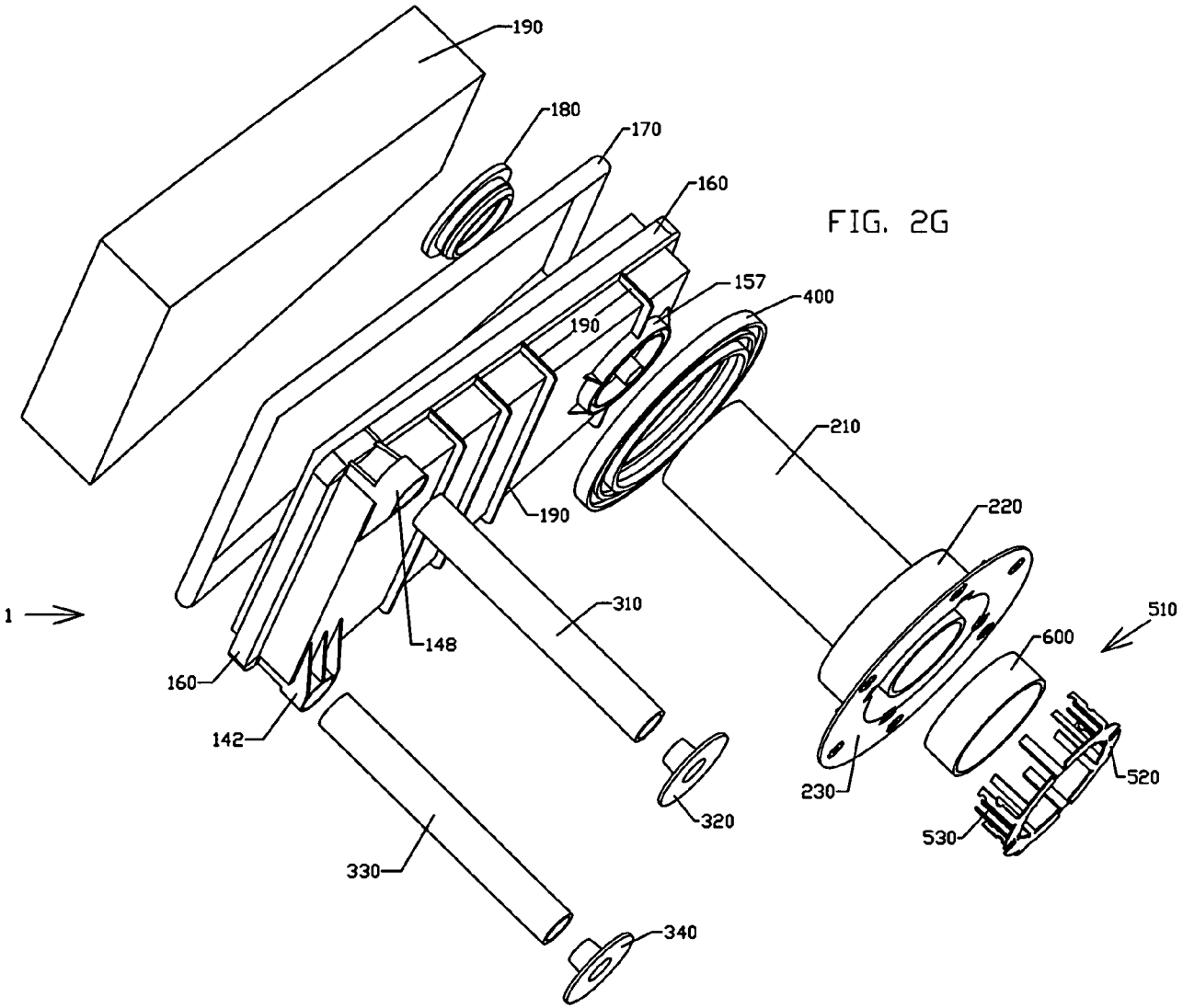
FIG. 2G is a lower left rear perspective exploded view of the tub box assembly.
Figure 2H:
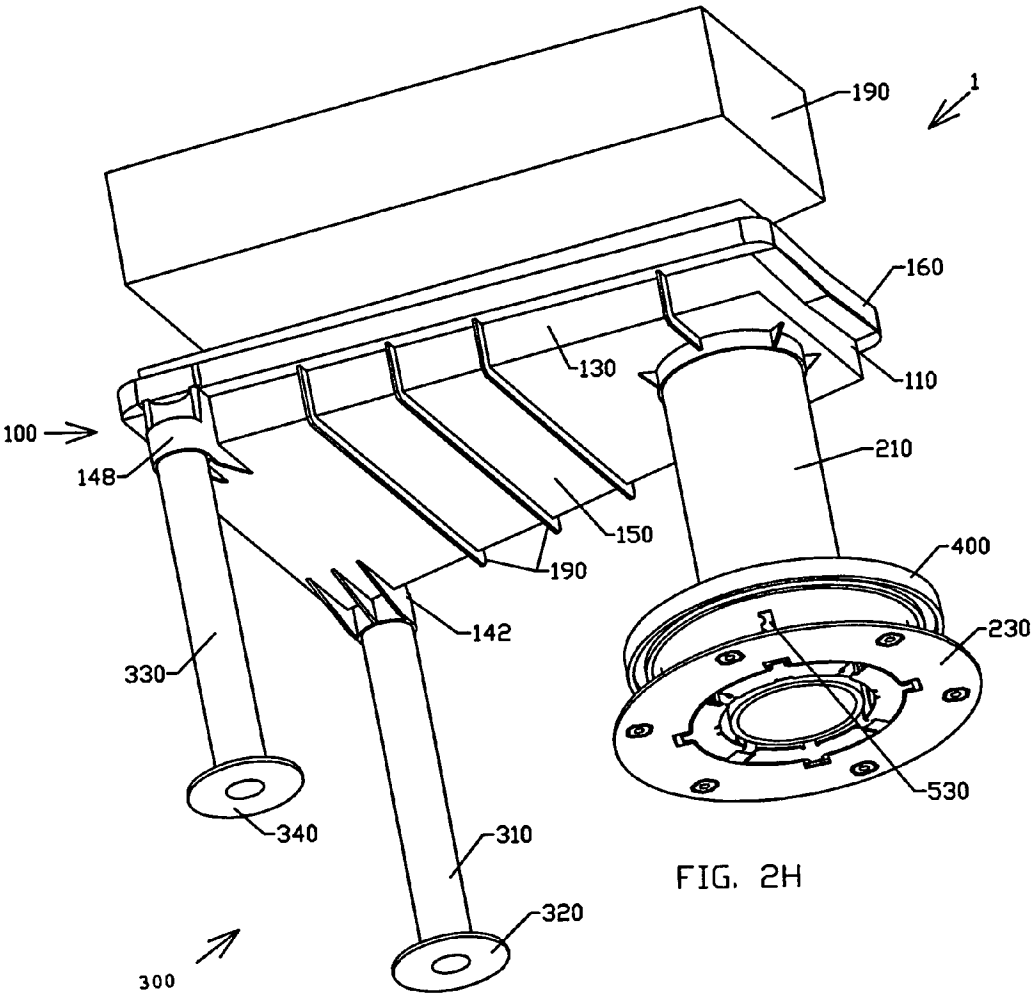
FIG. 2H is a rear end partial assembled view of the tub box assembly of FIG. 2G.

FIG. 2A is an exploded side view of the tub box assembly 1 of FIG. 1. FIG. 2B is an exploded, opposite side view of the tub box assembly 1 of FIG. 1. FIG. 2C is a front end exploded view of the tub box assembly 1 of FIG. 2A along arrow 2C. FIG. 2D is a rear end exploded view of the tub box assembly 1 of FIG. 2A, along arrow 2B. FIG. 2E is a top view of the tub box assembly 1 of FIG. 2A along arrow 2E. FIG. 2F is a bottom view of the tub box assembly 1 of FIG. 2A along arrow 2F. FIG. 2G is a lower left rear perspective exploded view of the tub box assembly 1. FIG. 2H is a rear end partial assembled view of the tub box assembly 1 of FIG. 2G.

Figures 3A, 3B, 3C:
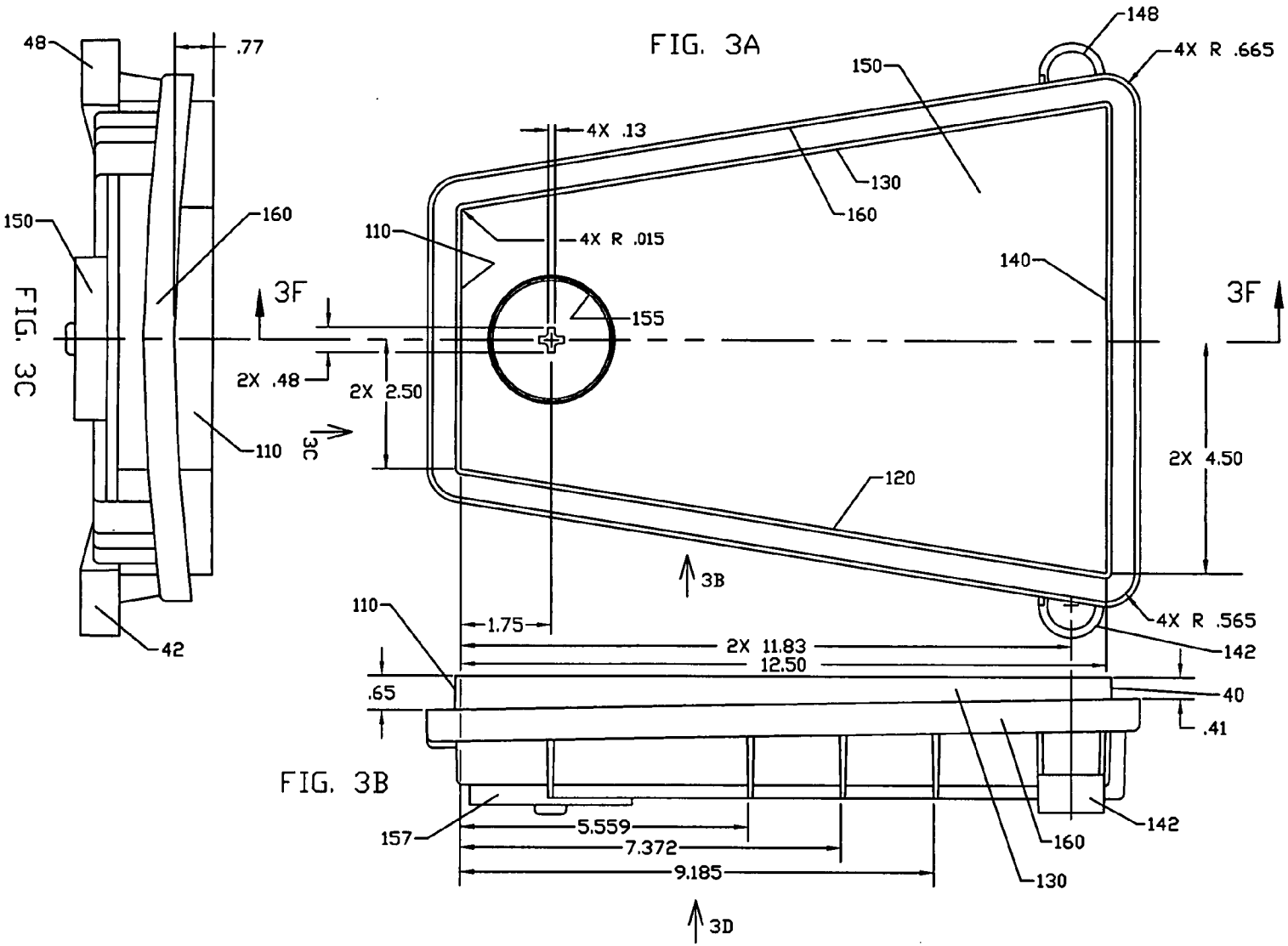
FIG. 3A is a top view of the tub box of the tub box assembly from the preceding figures.
FIG. 3B is a side view of the tub box of FIG. 3A along arrow 313.
FIG. 3C is a front end view of the tub box of FIG. 3A along arrow 3C.
Figure 3E:
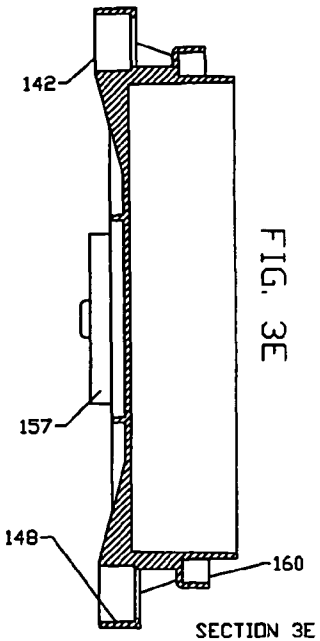
FIG. 3E is a rear end cross-sectional view of FIG. 3D along arrow 3E.
Figure 3D:
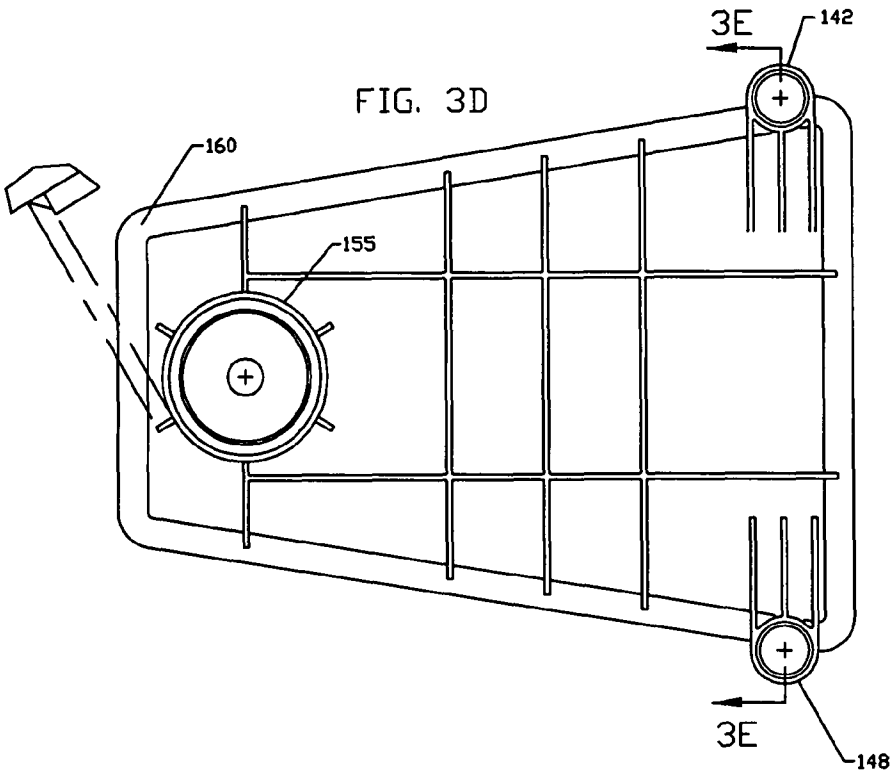
FIG. 3D is a bottom view of the tub box of FIG. 3B along arrow 3D.
Figure 3F:
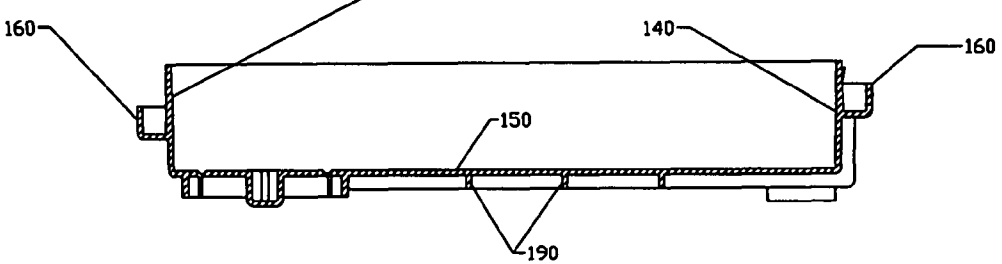
FIG. 3F is a side cross-sectional view of the tub box of FIG. 3A along arrow 3F.

FIG. 3A is a top view of the tub box 100 of the tub box assembly from the preceding figures. FIG. 3B is a side view of the tub box 100 of FIG. 3A along arrow 3B. FIG. 3C is a front end view of the tub box 100 of FIG. 3A along arrow 3C. FIG. 3D is a bottom view of the tub box 100 of FIG. 3B along arrow 3D. FIG. 3E is a rear end cross-sectional view of the tub box 100 of FIG. 3D along arrow 3E. FIG. 3F is a side cross-sectional view of the tub box 100 of FIG. 3A along arrow 3F.

Figure 4A:
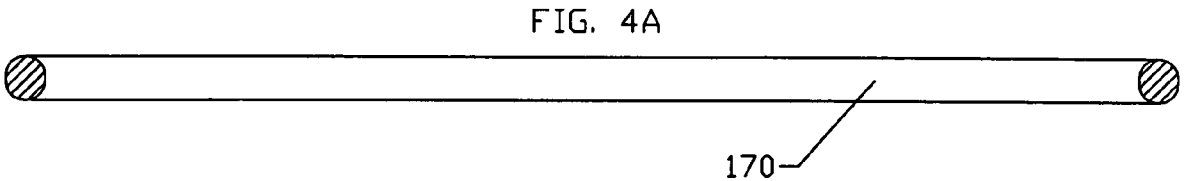
FIG. 4A is a cross-sectional view of the seal rod member of FIG. 4 along arrow 4A.
Figure 4:
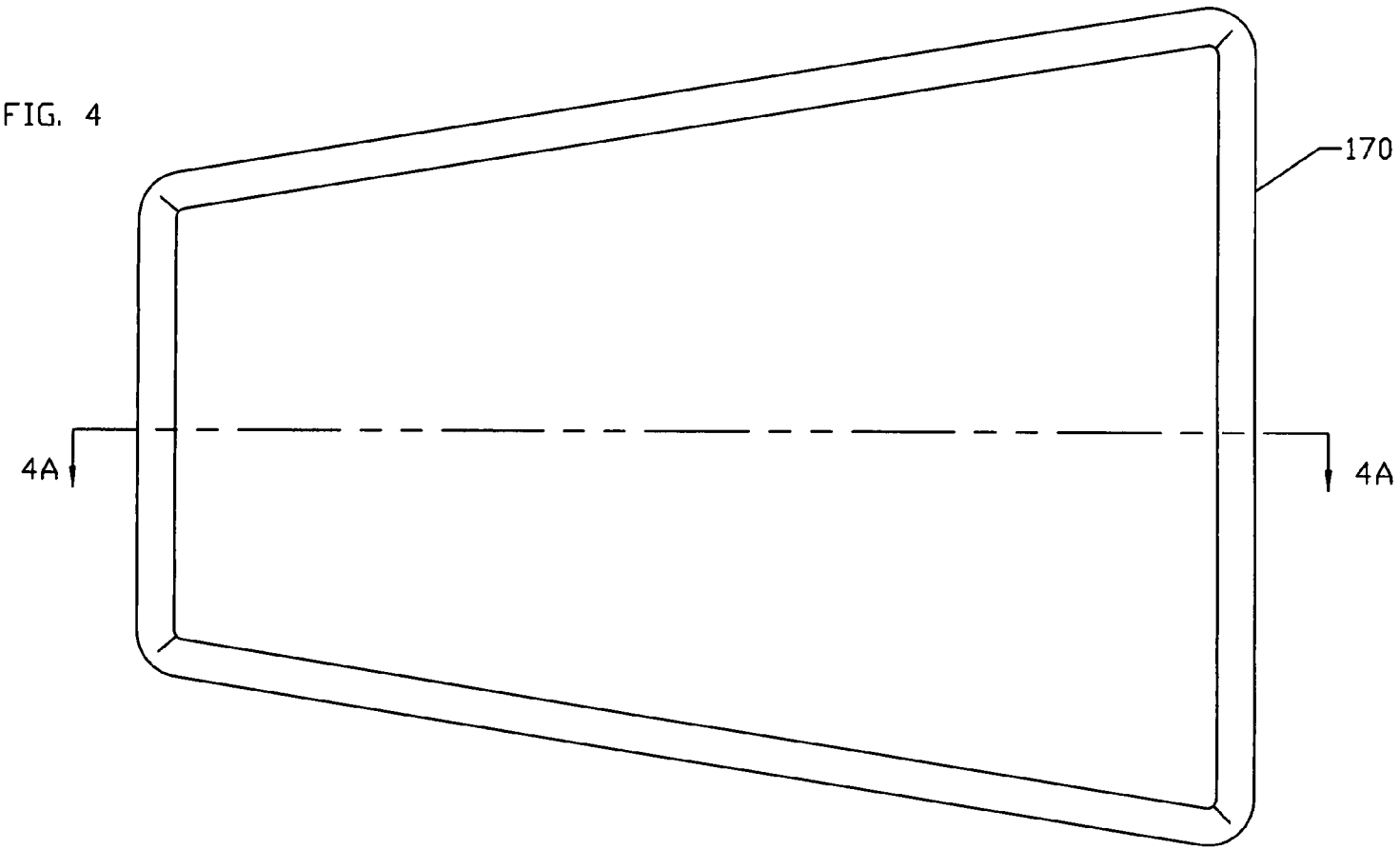
FIG. 4 is a top view of the trough seal rod member used in the tub box assembly.

FIG. 4 is a top view of the trough seal rod member (upper water barrier) 170 used in the tub box assembly 1. FIG. 4A is a cross-sectional view of the seal rod member (upper water barrier) 170 of FIG. 4 along arrow 4A.

Figures 5, 5A:
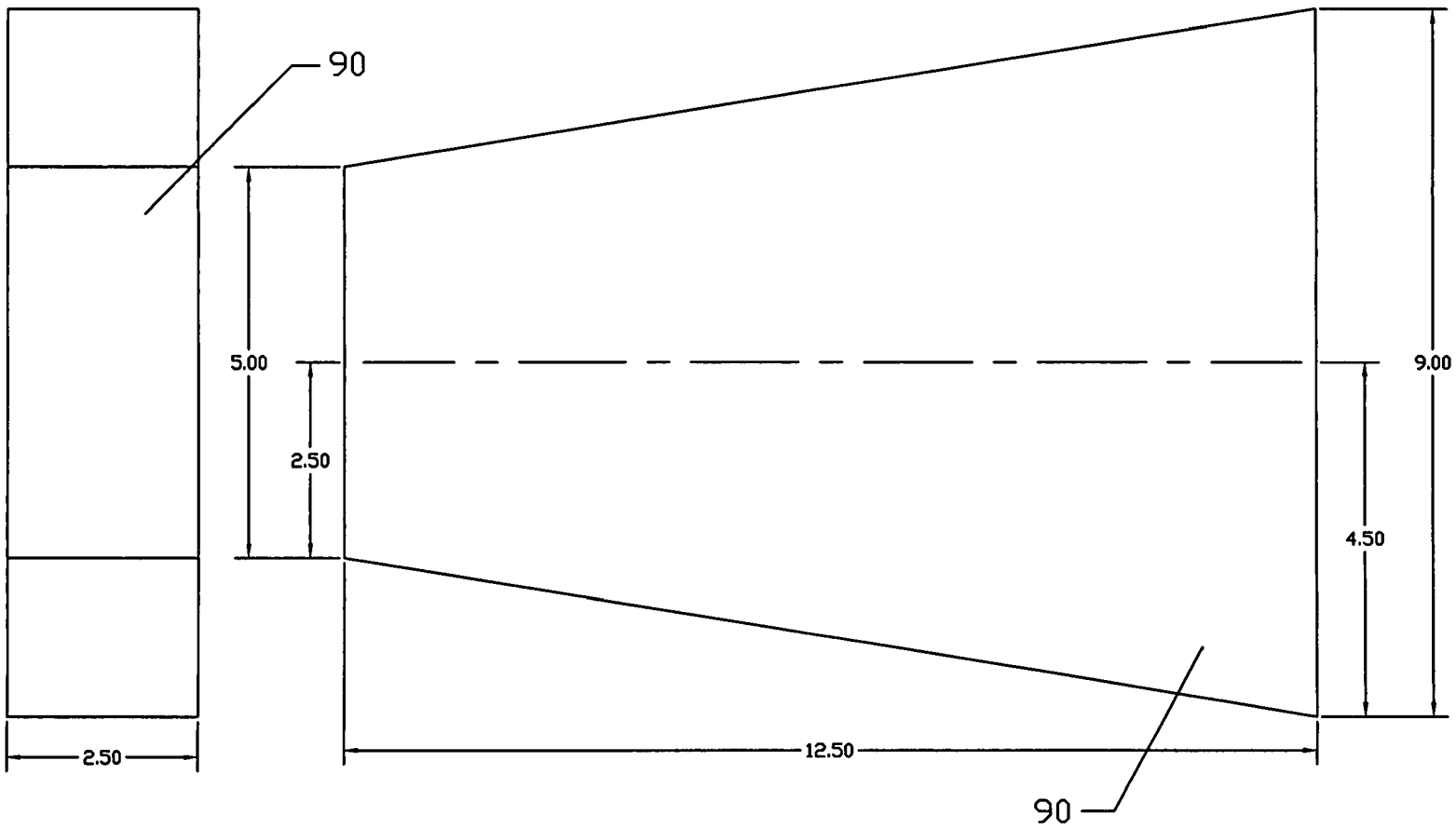
FIG. 5 is a top view of the foam insert used in the tub box assembly.
FIG. 5A is a front end view of the foam insert of FIG. 5 along arrow 5A.

FIG. 5 is a top view of the foam insert 90 that can be used in the tub box assembly 1. FIG. 5A is a front end view of the foam insert 90 of FIG. 5 along arrow 5A.

Referring to FIGS. 2A-5, a preferred embodiment of the main components of the tub box assembly can include a tub box 100 with lower extending tub box base 200, water barrier lower seal member 400, fire stop assembly 500 and lower seal member 700 for the tub box base 200. The tub box 100 can have an open box shape with floor 150 and front wall 110 having a smaller length than a rear wall 140 so that side walls 120 and 130 form a generally wedge shape. A trough type gutter 160 can be located around the outside perimeter of front wall 110, side walls 120, 130 and rear wall 140 and be positioned below the top edges of the respective walls. The trough/gutter 160 can be located at an angle so that the portion of the trough/gutter 160 against front wall 110 is below the portion of the trough/gutter against rear wall 140 so that any water that collects therein would tend to run downhill toward the front wall 110 located above the main drain 155.

Inside the trough/gutter 160 can be an elongated rod seal member (upper water barrier) 170 that can be formed from open cell foam, and the like to act as a sponge to absorb any water leakage that seeps in any cracks/crevices and openings between concrete floor 10 and the outer walls 110-140 of the tub box 100. In return the surrounding concrete helps draw water from trough area back in to the concrete.

Raised parallel ribs 190 can be about side walls 120, 130 and along the outside of floor 150 to act as both strengtheners for the tub box 100 and as buffers to block water seepage from passing to drain openings in the concrete floor 10. Extending from the rear wall portion 140 of the tub box 100 can be left rear pipe leg coupling 142 and right rear pipe coupling 148 that can be used to support and hold rear pipe legs 301 in place to the tub box 100. The tub box with trough/gutter 160, ribs 190 and leg couplings 142, 148 can be formed from molded plastic, and the like. A left rear pipe leg 310 can have an upper end mateably attached as a male member into the female coupling 142, and a right rear pipe leg 330 can have an upper end mateably attached as a male member into female coupling 148. Leg support feet 320, 340 can be attached to lower ends of pipe legs 310, 330, respectively, where the enlarged foot portions of the leg support feet 320, 340 can be positioned & secured below the concrete floor 10 to stabilize and hold the tub box 100 in place during the pouring of the concrete floor 10.

Attached to a main drain coupling 157 extending below the main drain 155 of the tub box can be a tub box base assembly 200, wherein the upper end of an elongated pipe upper base 210 is mateably coupled as a male member into the female coupling 157. Fixably mounted about the lower end of the elongated pipe upper base 210 can be the inside wail lower base 220 so that the lower end 215 of the elongated pipe base protrudes concentric within the hollow interior of the inside wall lower base 220. Extending outward from the bottom of the lower inside wall lower base 220 can be a flat mounting plate 230.

A fire stop assembly 500 can include a fire stop ring 520 and cylindrical fire stop wrap material 600 (nonflammable material). The fire stop ring 520 can have a lower ring portion 520 with upwardly protruding bendable tabs/prongs which can wrap about the fire stop wrap material holding it in place about the lower end 215 of elongated pipe upper base 210 within the lower inside wall lower base 220. Fire wrap material 600 can be an intumescence fire wrap that expands from the fire and heat to many sizes its size. With the heat expansion (intumescence), expansion begins at approximately 410 F (approximately 210 C) with a significant expansion at approximately 555 F (approximately 290 C). Free expansion applies to approximately 25 times (within approximately 5 minutes @ approximately 662 F (approximately 350 F).

Figure 6A:
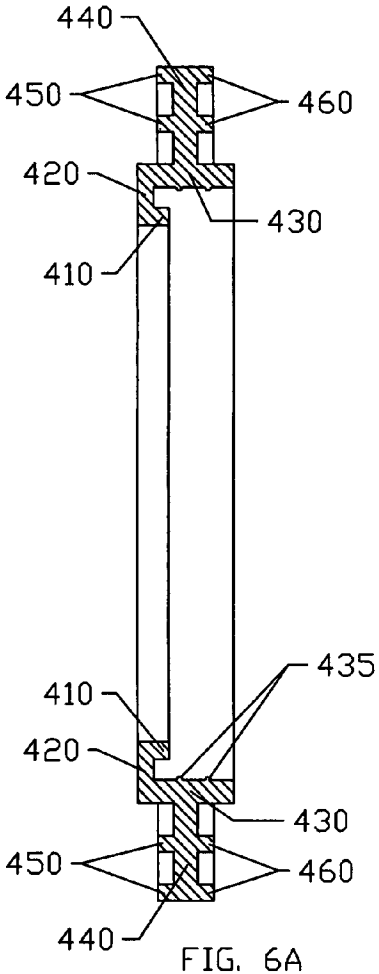
FIG. 6A is a side cross-sectional view of the water barrier lower seal ring of FIG. 6 along arrow 6A.

A water barrier lower seal member 400 which will be described in further detail in reference to FIGS. 6-6A adds an extra seal about the tub base 200 and the concrete floor 10. Additionally, a lower seal member 700 adds an extra water seal about the lower end of tub base box 200.

Figure 6:
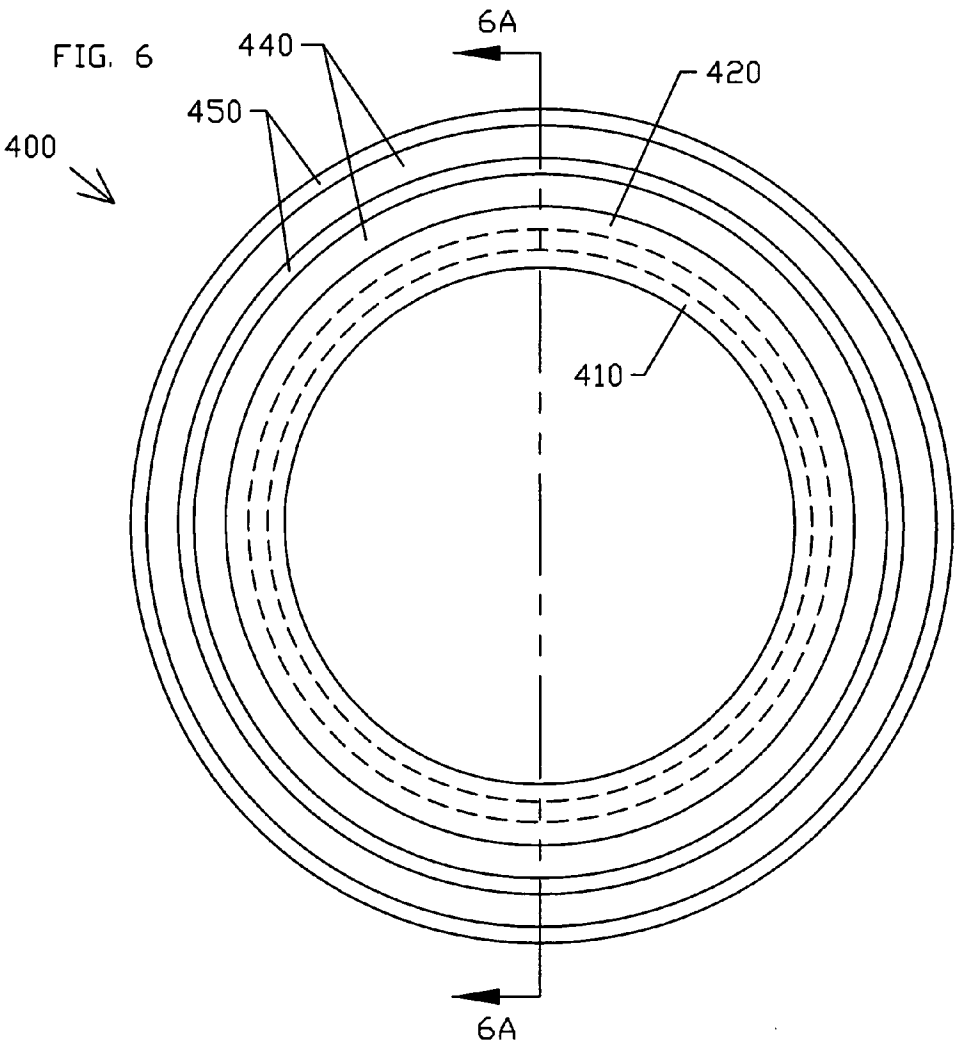
FIG. 6 is a top view of the water harrier lower seal ring used in the tub box assembly.

FIG. 6 is a top view of water barrier lower seal ring 400 used in the tub box assembly. FIG. 6A is a side cross-sectional view of the water barrier lower seal ring 400 of FIG. 6 along arrow 6A. The water barrier lower seal ring 400 can be a resilient material such as a seal/pliable material, and the like, and can have an inner clip edge 410 such as an interior concentric lip that attaches to an outer concentric wall member 430 by an upper roof edge 420 so that the water barrier lower seal ring 400 can wrap about a raised circumferential edge 222 of the inside wall lower base 220 (see for example FIG. 1). Extending out sideways from outer wall member 430 can be a generally flat ring 440 having raised concentric upper ridges 450, and lower ridges 460, the latter of which add extra water sealing to any water that travels outside of the tub box base from the bottom of the tub box 100.

Figure 7A:
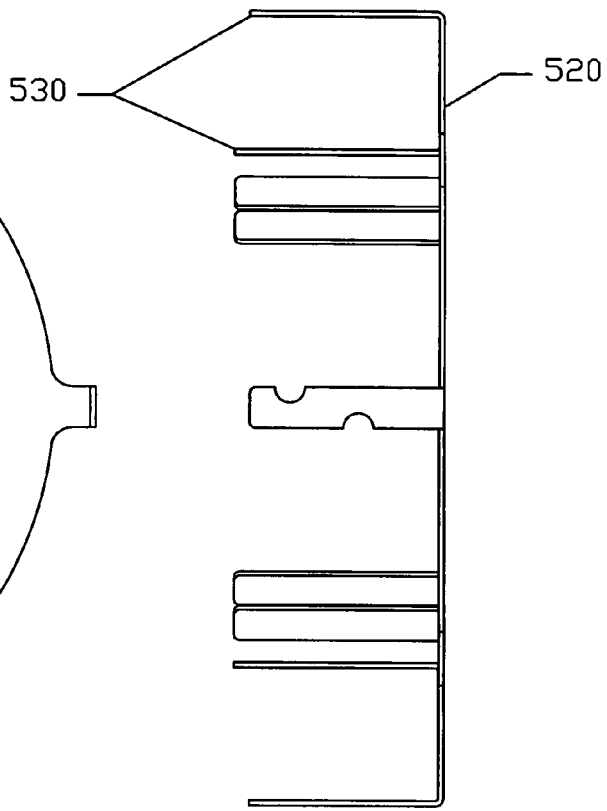
FIG. 7A is a side cross-sectional view of the fire stop ring of FIG. 7 along arrow 7A.
Figure 7:
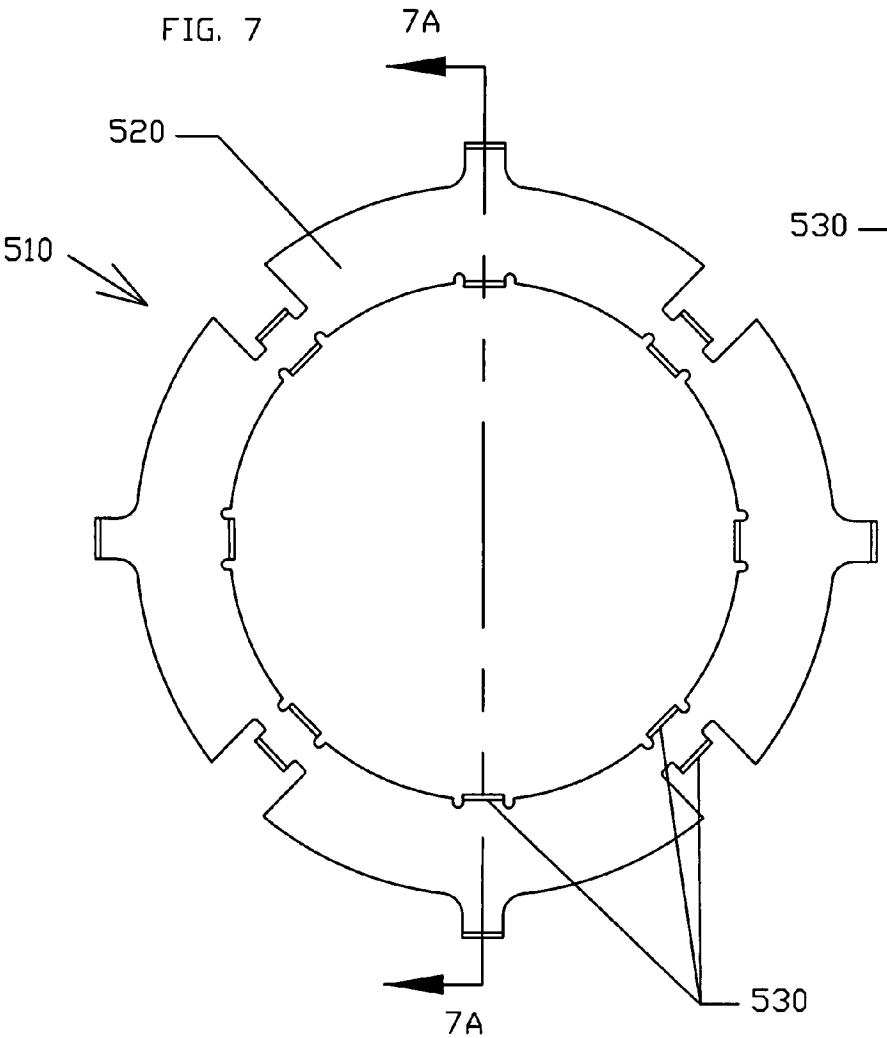
FIG. 7 is a bottom view of the fire stop ring used in the tub box assembly.

FIG. 7 is a top view of the lower fire stop ring 520 used in the tub box assembly 1. FIG. 7A is a side cross-sectional view of the lower fire stop ring & prongs 510, 520 & 530 of FIG. 7 along arrow 7A which can have a ring portion 520 and upwardly extending bendable tabs/prongs 530. The lower fire ring 520 can be formed from metal such as but not limited to aluminum, galvanized metal, and the like.

Figures 8, 8A, 8B, 8C:
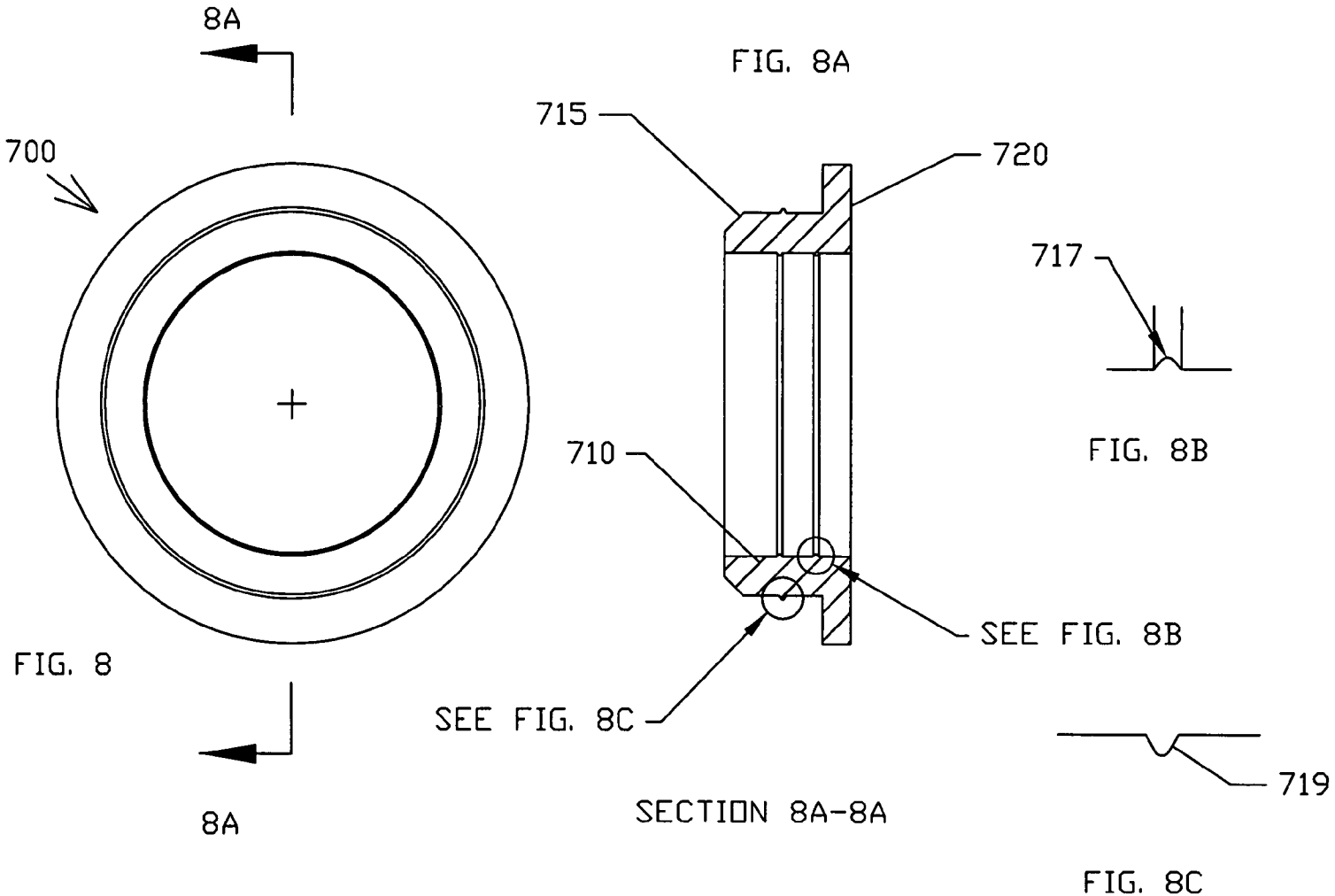
FIG. 8 is a top view of the tub box seal for the tub box base.
FIG. 8A is a side view of the tub box seal of FIG. 8 along arrow 8A.
FIG. 8B is an enlarged view of section 8B of FIG. 8A.
FIG. 8C is an enlarged view of section 8C of FIG. 8A.

FIG. 8 is a top view of the tub box seal 700 for the tub box base 200. FIG. 8A is a side view of the tub box seal 700 of FIG. 8 along arrow 8A. FIG. 8B is an enlarged view of section 8B of FIG. 8A. FIG. 8C is an enlarged view of section 8C of FIG. 8A. Tub box seal 700 can have a plug/seal portion 710 having inwardly angled ends 715 for inside the lower open end 215 of elongated pipe upper base 210 (shown in FIG. 1), and having an enlarged head portion/plug seal top 720. Additional sealing protruding rings 717, 719 will be used for additional sealing of the drain openings in the concrete floor 10 and prevent any water leakage therethrough.

FIG. 9 is another cross-sectional view of the assembled tub box assembly 1 of the preceding figures in a concrete floor 10 with bathtub 800 mounted to the tub box assembly 1.

A tub knockout 300 will be inside the tub box 100 and be removed after the concrete pour and the appropriate testing of the drain lines are complete.

The operation and the function of the tub box device is generally for the installation of the drain and overflow of the bath tub 800 and will now be described in reference to FIGS. 1-.9. When the rub box assembly 1 is installed in the concrete slab 10 it will form out a void for the drain and overflow to fit in so it is under the tub 800. General assemblies of tub boxes into concrete floors are described, for example in U.S. Pat. No. 4,823,527 to Harbeke, which is incorporated by reference. The tub box assembly 1 protects the opening 15 (concrete floor slab) in which the tub box device is in against water intrusion and fire intrusion through the entire penetration in which the device is installed within.

Tub box 100 can have a piece of 2½" Styrofoam 90 that can be inserted in to the tub box 100 to make up the pour thickness and to also protect the inside of the tub box 100 during the pour of the concrete so concrete does not get in the tub box 100.

The tub box assembly 1 can have a water barrier lower seal member 400 that can be placed on the tub box base 200, where the water barrier lower seal member 400 being formed from a resilient material, and the like, can expand and contract with the concrete 10 while at the same time allowing for a water tight seal between the concrete slab 10 and the tub box base 200. This water barrier lower seal member 400 is to stop water intrusion from the upper part of the concrete slab 10 to the underside of the concrete slab 10 in which the tub box assembly 1 is installed within.

The tub box 100 can have a trough/gutter 160 built around the outside rim walls 110-140 of the tub box 100 which also helps against water intrusion. A piece of open cell backer rod material upper water barrier 170 can be compressed in to the trough 160. This trough 160 is used to hold water that may intrude between the tub box 100 and the concrete slab 10 in which it is installed. The backer rod material upper water barrier 170 that is compressed in the trough 160 can absorb water while allowing the concrete 10 to draw the water from the backer rod 170 and trough area back in to the concrete slab 10. The trough/gutter 160 can be on a slope towards the front of the tub box 100 and tub box base where the water barrier lower seal 400 is on.

The sloped trough/gutter 160 allows any access water to flow down the trough to the front of the tub box 100 where it will overflow out of the trough 160 in to the concrete. Any access water from the trough 160 is to flow towards the water barrier lower seal member 400 an the tub box base 200 while allowing for a water tight seal between the water barrier lower seal member 400 and the concrete 10 in which the tub box assembly 1 is installed within. The trough 160 is to stop water intrusion from reaching the back legs 310 & 330 on the tub box 100; this is why the trough is on a slope towards the front of the tub box. The trough 160 is used to divert any water intrusion towards the water barrier lower seal member 400 on the tub box base 200 where the water barrier lower seal 400 forms a water tight seal between the concrete slab 10 and the tub box base 200 and water barrier lower seal member 400 of the tub box assembly 1.

The ribs 190 on the bottom and sides of the tub box 100 are for strength of the tub box 100 itself and also for stopping the flow of water from the front underside of the tub box 100 to the back underside of the tub box.

The tub box 100 can have two seals 700 and interior raised rib edges 219 that will adapt the tub box base 200 and tub box 100 to except either 1½ " schedule 40 PVC pipe (drain and overflow for tub), PVC tubing size (drain and overflow for tub) or brass (drain and overflow for tub). These two seals can be used according to the application which may require the seal to be used in the tub box or the bottom of the tub box base. The plumber will only use one of the seals for which ever application he is using for the tub box. The plumber will have to use the appropriate fittings for the drain on the bottom of the tub box base, the bottom of the base can except 2" pipe (drain) which will be glued in to the bottom of the tub box base or use a reducer bushing to adapt to 1½" pipe (drain) if applicable. When using the tubing size PVC or brass (drain and overflow for tub) you will use the correct seal that will insert in the tub box at the top, this will allow the plumber to glue a 2" drain in to the bottom of the tub box base or glue a reducer bushing in the bottom of the tub box base to adapt to 1½" drain pipe, whichever is applicable.

On the seal for the schedule 40 PVC (drain and overflow for tub) the plumber can insert it in the tub box top or bottom it all depends on the application. It all depends on how much clearance is needed under the tub for the drain connection. If the tub is high enough you can put the appropriate seal in the top of the tub box, this will allow the plumber to glue in a 2" drain in the bottom of the tub box base or glue a reducer bushing when 1½" drain pipe is used. The plumber can also use cast iron or copper drain pipe with the appropriate fittings to adapt to the bottom of the tub box base on both schedule 40 PVC or tubing size/brass drain & overflow for tub. In the application where you do not have the clearance you will insert the seal for schedule 40 PVC (drain and overflow for tub) in the bottom of the tub box base and use the appropriate fittings to adapt to the size of drain pipe you are using "1½", 2" or cast iron pipe size.

For fire protection, the tub box base 200 can have a tire stop assembly 500 having a lower fire ring & prongs that hold fire material 520 & 530 and fire wrap material 600 that inserts in the bottom of the tub box base 200. This part of the assembly works in case there is a fire and the way it works is when there is a fire it will cause the fire ring 520 to heat up and also draw heat to the fire wrap material 600 causing the fire wrap material 600 to expand during a fire. When this happens it will start to expand and start to close off the opening where the pipe is running through the tub box device. Everything works together, when the pipe starts to melt the tire wrap material is already expanding to close off the opening. This will keep the fire from penetrating through the openings 15 in the concrete slab 10.

Figure 10:
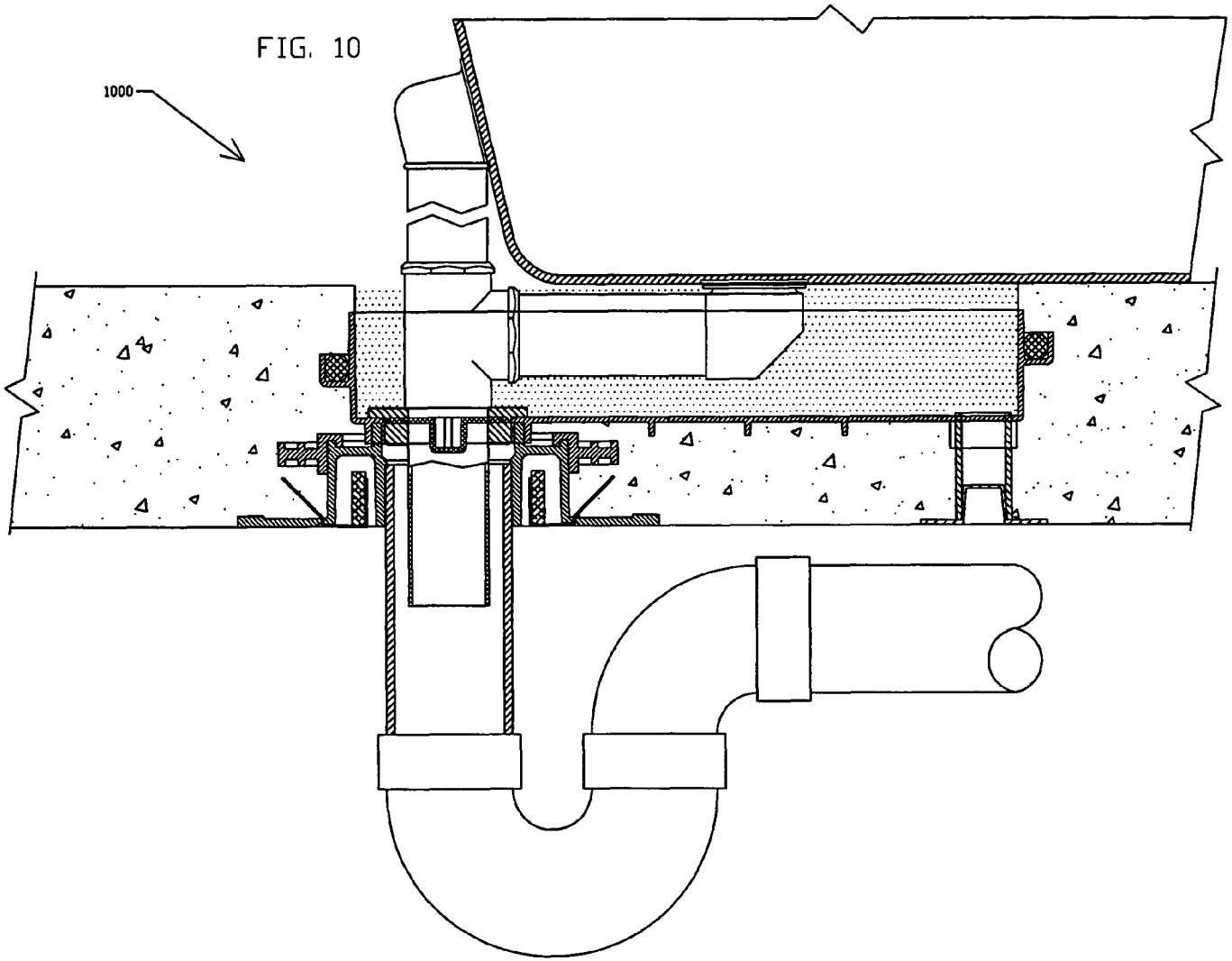
FIG. 10 is a cross-sectional view of another assembled tub box assembly in a concrete floor with bathtub mounted thereto for 1" drain.

FIG. 10 is a cross-sectional view of another assembled tub box assembly 1000 in a concrete floor with bathtub mounted thereto for the tubing sized drain. The invention tub box assembly can be used with all the features or can be used with only one or any combination of the sealing and fire stop features.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A tub box system, comprising:

a tub box having a floor and perimeter side walls encircling about the floor; and a seal member for preventing water leakage from passing through a concrete floor in which the tub box is installed, and passing downward, wherein the seal member includes:

a trough completely encircling about all exterior perimeter side walls of the tub box, wherein the trough forms a gutter for collecting any of the water passing around the exterior perimeter side walls and the concrete floor, a base extending downward from a main drain opening in the tub box, and a water barrier lower seal about the base, the water barrier lower seal able to expand and contract with the concrete floor in which it is installed while forming a water seal between the concrete floor and the base.

2. The tub box system of claim 1, wherein the trough further includes:

a mount for mounting the trough below a top edge of the perimeter side walls of the tub box.

3. The tub box system of claim 1, wherein the seal member further includes:

an elongated sponge/absorbent material within the trough for absorbing any of the collected water.

4. The tub box system of claim 3, wherein the elongated sponge includes:

a one piece backer rod material of open cell foam/absorbent material compressed into the trough.

5. The tub box system of claim 1, wherein the water barrier lower seal includes:

a ring having flat sides extending outward from a center opening; and at least one concentric raised ridge in the flat sides.

6. The tub box system of claim 5, wherein the at least one concentric raised ridge is protrudes upward.

7. The tub box system of claim 5, wherein the at least one concentric raised ridge protrudes downward.

8. The tub box system of claim 1, wherein the at least one concentric raised ridge includes:

at least one upward protruding ridge on the flat sides and at least one downward protruding ridge on the flat sides.

9. The tub box system of claim 1, further comprising:

a fire stop material circumferentially wrapped about a lower portion of the downwardly extending base, the fire stop material expands from heat to prevent fire from traveling upward around the main drain opening.

10. The tub box system of claim 9, further comprising:

a ring shaped clip with a central opening and upwardly projecting outside bendable prongs, wherein the central opening of the ring shaped clip fits about the main drain opening, and the bendable clips hold the fire stop material about the lower portion of the downwardly extending base, the outside prongs on the fire ring will insert through the bottom base then bend over on an approximately 45 degree angle.

11. A tub box system, comprising:

a tub box having a floor and perimeter side walls encircling about the floor; and a seal member for preventing water leakage from passing through concrete floor in which the tub box is installed, and passing downward, wherein the seal member includes a trough completely encircling about all exterior perimeter side walls of the tub box, wherein the trough forms a gutter for collecting any of the water passing around the exterior perimeter side walls and the concrete floor; and rows of raised ribs underneath the floor of tub box and about exterior of the perimeter side walls for both strengthening the tub box and for obstructing the water leakage flowing around the tub box.

12. A tub box system, comprising:

a tub box having a floor and perimeter side walls encircling about the floor; and a trough completely encircling about all exterior perimeter side walls the tub box, wherein the trough forms a gutter for collecting any of the water passing around the exterior edges of the perimeter wall and a concrete floor in which the tub box is installed;

a base extending downward from a main drain opening in the tub box; and a water barrier lower seal about the base, the water barrier lower seal able to expand and contract with the concrete floor in which it is installed while forming water seal between the concrete floor and the base, the water barrier lower seal having a ring having flat sides extending outward from a center opening, with at least one concentric raised ridge on the flat sides; and fire stop material wrapped about a lower portion of the downwardly extending base, the fire stop material expands from heat to prevent fire from traveling upward about the main drain opening.

13. The tub box system of claim 12, further comprising:

an elongated sponge/absorbent material in the trough for absorbing the collected water.

14. The tub box system of claim 13, further comprising:

a ring shaped clip with a central opening and upwardly projecting bendable prongs, wherein the central opening of the ring shaped clip fits about the main drain opening or pipe, and the bendable clips hold the fire stop material about the lower portion of the downwardly extending base and the outside prongs on the fire ring are for securing the ring in to the concrete.

15. The tub box system of claim 12, wherein the tub box includes:

rows of raised ribs underneath the floor tub box and about exterior of the perimeter side walls for both strengthening the tub box and for obstructing the water leakage flowing around the tub box.

* * * * *